US007246388B2

(12) United States Patent
DiLiberto, Jr.

(10) Patent No.: US 7,246,388 B2
(45) Date of Patent: Jul. 24, 2007

(54) MATTRESS ASSEMBLY

(76) Inventor: Samuel L. DiLiberto, Jr., P.O. Box 119, Caledonia, NY (US) 14423

( * ) Notice: Subject to any disclaimer, the term of this patent is extended or adjusted under 35 U.S.C. 154(b) by 2 days.

(21) Appl. No.: 11/285,335

(22) Filed: Nov. 22, 2005

(65) Prior Publication Data

US 2006/0123543 A1 Jun. 15, 2006

Related U.S. Application Data

(63) Continuation-in-part of application No. 10/904,144, filed on Oct. 26, 2004, now Pat. No. 7,127,755.

(60) Provisional application No. 60/514,797, filed on Oct. 27, 2003.

(51) Int. Cl.
*A47C 21/08* (2006.01)

(52) U.S. Cl. ..... 5/425; 5/426; 5/663; 5/732

(58) Field of Classification Search ..... 5/424–427, 5/732, 946, 663, 193
See application file for complete search history.

(56) References Cited

U.S. PATENT DOCUMENTS

| | | | | |
|---|---|---|---|---|
| 421,656 | A | 2/1890 | Blanken | |
| 3,148,387 | A * | 9/1964 | Sarnie, Jr. et al. | 5/632 |
| 3,402,409 | A * | 9/1968 | Kain | 5/426 |
| 3,742,530 | A | 7/1973 | Clark | |
| 3,938,205 | A | 2/1976 | Spann | |
| 4,215,446 | A | 8/1980 | Mahoney | |
| 4,672,698 | A | 6/1987 | Sands | |
| 5,421,046 | A | 6/1995 | Vande Streek | |
| 5,815,863 | A | 10/1998 | Dolisi | |
| 5,926,873 | A | 7/1999 | Fountain | |
| 6,067,679 | A | 5/2000 | Rice | |
| 6,453,490 | B1 * | 9/2002 | Cardinale | 5/426 |
| 6,668,399 | B2 * | 12/2003 | Malstaff et al. | 5/424 |
| 6,721,974 | B1 | 4/2004 | Wilkinson | |
| 6,739,001 | B2 * | 5/2004 | Flick et al. | 5/425 |
| 6,952,847 | B1 * | 10/2005 | Cleary | 5/430 |
| 7,127,755 | B1 * | 10/2006 | Stacy et al. | 5/424 |

FOREIGN PATENT DOCUMENTS

| | | | |
|---|---|---|---|
| GB | 2326088 | A | 12/1998 |

* cited by examiner

*Primary Examiner*—Michael Trettel
(74) *Attorney, Agent, or Firm*—Howard J. Greenwald, P.C.

(57) ABSTRACT

A safety apparatus for a bed comprised of two safety panels and a cover. Each safety panel comprises a horizontal stabilizer and vertically-extending panel of a synthetic polymeric material with a density of from about 1 to about 10 pounds per cubic foot. The width of the stabilizer is less than about 20 per cent of the width of the mattress. Disposing the horizontal stabilizer underneath a mattress secures said the vertically-extending panel in a substantially-vertical orientation along a side of said bed. Another embodiment comprises the foregoing side panel safety apparatus in combination with a safety rail of said bed, further comprising said safety rail; wherein said horizontal stabilizer blocks a person in said bed from moving a part of said person's body into contact with said safety rail such that said body part becomes entrapped from said contact. Another embodiment comprises movable vertical sections.

20 Claims, 9 Drawing Sheets

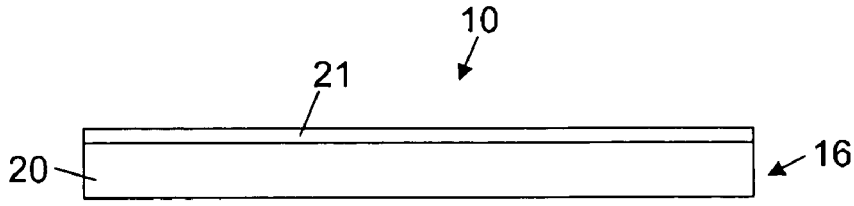
Figure 4
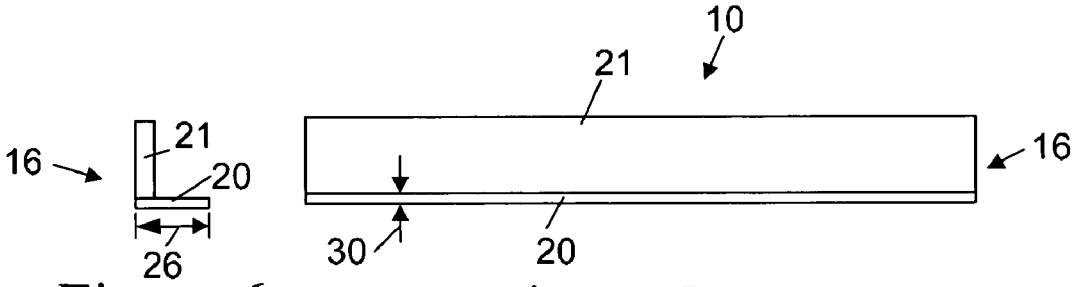
Figure 6
Figure 5
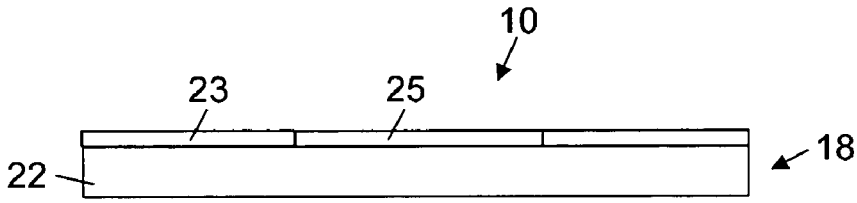
Figure 7
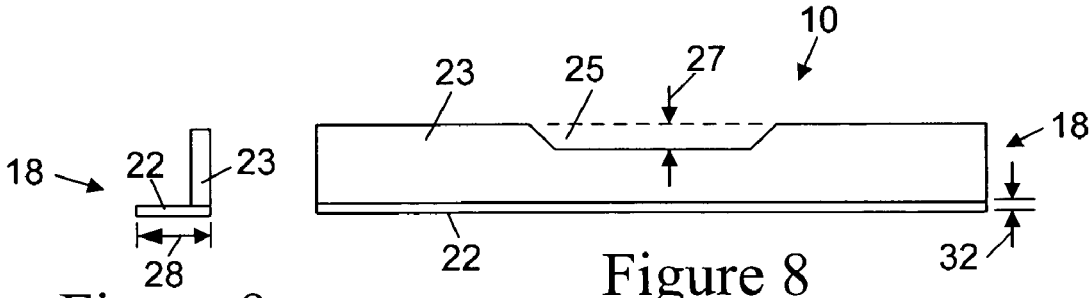
Figure 9
Figure 8

MATTRESS ASSEMBLY

This patent application is a continuation-in-part of U.S. Ser. No. 10/904,144 (filed Oct. 26, 2004) now U.S. Pat. No. 7,127,755 claiming the benefit of provisional application U.S. Ser. No. 60/514,797 (filed on Oct. 27, 2003). The entire disclosures of said applications are incorporated by reference into this specification.

BACKGROUND OF THE INVENTION

Patients in hospitals or long-term care facilities often reside in beds disposed between safety rails. Although the use of these safety rails provides some degree of protection against the risk of the patient falling off the bed, these safety rails present their own safety concerns. In some situations, patients prefer to lower the bed rails to increase comfort, disengaging the safety feature and its protective effects.

Patients, especially elderly or "developmentally disabled" patients, frequently self-inflict injuries by trapping their heads, buttocks, legs, feet, hands, arms, torso, or other body parts between the safety rails and the mattress. Degrees and severity of entrapment can vary from patient to patient depending on height, weight, cognitive function, level of ambulatory ability, and other factors. Injuries sustained also vary according to the type and length of entrapment. Bruising, sprains and breaks would result from minor events. More serious injuries, including death, can also occur in cases of prolonged events involving choking or suffocating entrapments. These safety concerns have given rise to a multiplicity of lawsuits against hospitals and long-term care facilities. For example, the Long Island, N.Y. Developmental Disabilities Service Office has been sued at least twice for injuries and or deaths resulting from a patient's entrapment with a safety rail assembly.

The management of one care facility located in Schenectady, N.Y. has discontinued the use of safety rail assemblies in some cases, and now has those patients sleeping on mattresses that have been placed upon the floor. As is apparent, this alternative arrangement is not optimal and presents its own set of problems.

U.S. Pat. No. 6,721,974 (Safety Equipment for Beds) elaborates on some of the problems and approaches to solving these problems: "Attempts to prevent such injury have included many variants of inflatable or padded supports capable of fitting to, or replacing, the sides of the bed or cot so as to better absorb the impact of the body against the hard structure. An example of this type of support is known from GB2326088A which discloses inflatable tubes, or compartments, which can be fitted to a bed to prevent a person from falling out of bed or from coming into contact with the solid structure of the bed. The tubes are releasably fined to the bed structure by means of ties."

"However, in solving one problem, this type of solution could introduce an additional difficulty: the bed occupant becoming stuck in the gap described by the interface of the inflatable side support and the mattress. An alternative approach disclosed in GB868320 goes some way to solving this problem of preventing the occupant from becoming stuck in the aforementioned gap, by attaching the mattress to the "safety fence" in such a manner as to eliminate the gap. However, the low sides of this safety fence are designed solely to prevent the occupant from falling out of the bed and not from sustaining injury as a result of contact with nearby solid structure during the course of a fit or other such uncontrolled body movement. Furthermore, U.S. Pat. No. 5,421,046 discloses "bumper pads" for fitting to a child's cot with traditional solid surrounds." The entire disclosure of each of these United States patents is incorporated by reference into this specification.

U.S. Pat. No. 4,672,698 (Bed Rail Cushion System) also elaborates on some approaches to solving these problems: "Removable padding arrangements for beds are known as illustrated, for example, by U.S. Pat. Nos. 421,656; 3,742,530; 4,215,446 and West German patent 614,367. These siderail padding arrangements are of two general types, the first being where the padding arrangement and the siderail for the bed are an integral arrangement and must be affixed to or removed from the bed together. A second type relates to padding arrangements to cover the existing siderails on hospital type beds with these being a relatively thin flexible padding arrangement which folds over and snaps to the bed siderail. The integral type padding arrangements are inconvenient and not adaptable to a wide variety of currently manufactured beds while the latter variety provide at best inadequate padding and typically allow the patient a gap or space between the bed mattress and the padded rail into which an arm, elbow or ankle may easily slip providing an opportunity for patient injury. It would be highly desirable to have a padding arrangement for a hospital type bed which was readily attached or removed and which completely filled any gap between the mattress and the pad while affording the patient maximum padding protection." The entire disclosure of each of these United States patents is incorporated by reference into this specification.

U.S. Pat. No. 4,672,698 (Bed Rail Cushion System) also elaborates on patents with devices and methods that attempt to solve these problems:" The U.S. Pat. No. 6,067,679 discloses a prop to hold a patient on his/her side while in a hospital bed in which a standard-sized hospital pillow is stowed in a rolled condition within a launderable sleeve. The sleeve has a flap that is tucked beneath the patient's side which allows limited patient rolling movement against the prop which contributes to patient comfort. The flap also keeps the prop close to the patient so that drastic movements which could cause injury do not occur. The U.S. Pat. No. 5,815,863 discloses a lateral slumber support wedge for supporting a user, such as a pregnant woman, in a lateral slumber support, while lying down on either the left side or the right side. The wedge provides compressible, but firm support for the spine and pelvic region of the user. The wedge has a triangular cross section, and an interior body made of foam, which can provide support, but which conforms to the spinal and pelvic regions of the user. The wedge also includes a fabric cover which is permanently sewn to a bed sheet dividing the sheet in half so it can be used by the user lying on either the left or right side. The U.S. Pat. No. 3,938,205 discloses a body positioner that is formed from a block of polyurethane foam having resilient characteristics capable of deformation and of permitting the passage of air. The positioner has an unsymmetrical pentagonal cross-section and a length substantially greater than its width so that the positioner can be rotated to provide for a variety of adjustable continuous positioning support surfaces." The entire disclosure of each of these United States patents is incorporated by reference into this specification.

U.S. Pat. No. 4,672,698 discloses a rigid bed rail cushion system that pads designed to provide a gap-free junction between the padded rails and the bed mattress. The entire disclosure of this United States patent is incorporated by reference into this specification. The disadvantages of these structures has been described above.

U.S. Pat. No. 6,721,974 discloses safety equipment for beds that comprise an inflatable wall structure secured to the sheeting to form a barrier against falling out of bed and a cushion against injury against the bed rails. The entire disclosure of this United States patent is incorporated by reference into this specification. While this device addresses some of the problems in the prior art, it has not proven completely satisfactory.

For example, the device described in U.S. Pat. No. 6,721,974 requires customized sheeting or certain ties and/or tabs to secure the device while in use. This may be inconvenient or cause additional cost to the user. In addition disclosed are four inflatable walls which are tied (or otherwise secured together) at their respective corners. Thus, in order to facilitate access to the bed or patient within the bed, or to facilitate patient entry or exit to and from the bed, it would be required that at least one side be untied or disengaged.

Additionally, the base of the device is substantially the same size as the mattress placed over or in it while in use. Thus, the manufacturer must make a multiplicity of sizes to accommodate various mattress sizes. Additionally, should a mattress be slightly deformed or manufactured imperfectly, a risk of a gap between the mattress and the wall of the device is created, defeating the very purpose of using the device to prevent gaps and decrease the possibility of entrapment.

Another disadvantage is that some polymeric materials used to manufacture inflatable devices support the growth of bacteria or produce latex-type allergic reactions in some patients.

The present invention, comprised substantially of foam, offers a latex-free, bacteria growth free alternative for the user. Comprised of foam material, it is not subject to failure such as puncture or deflation.

The present invention offers many conveniences to the user. First, it does not require special sheets, ties, or tabs. Standard sheets may be used with the present invention. Secondly, the use of side panels allows the user to incorporate a single panel, or a combination of panels, such that it is not necessary for all sides of the bed to be affixed with safety side panels if such was not desirable or convenient. Thirdly, since the stabilizer of the safety side panel slides under the mattress until it abuts tightly against it, a gap-free fitting to any size mattress may be accomplished without the necessity of multiple sizes or versions, an economic advanatage to manufacturers and distributers.

Fourthly, the cutout section in the safety side panel facilitates patient access without the necessity of the delay or extra steps of disengaging the device. Additionally, without the delay of the inflation steps, the present invention is also time saving to the user during the set-up process. Lastly, the present invention offers a fire retardant cover, meeting safety standards for instutional or infant use.

Similarly, the present invention offers advantages over the crib railing guard disclosed in U.S. Pat. No. 5,926,873 by incorporating a stabilizer whose width is substantially less than the width of the mattress and is not affixed to the crib railing. Thus, the safety side panel is self-supporting, not requiring the side rails for support or to be disengaged to facilitate access.

Thus, an economical and practical solution to these problems and hazards will provide benefits to both the patients and their caregivers.

SUMMARY OF THE INVENTION

In its broadest context, a preferred embodiment of the present invention consists of a side panel safety apparatus for a bed arranged to block a person in the bed from moving a part of his body into contact with a safety rail such that the body part becomes entrapped from contact. Such components are individually configured and correlated with respect to each other so as to attain the desired objective. Disclosed herein is a safety apparatus for a bed comprised of a first safety panel comprising a first horizontal stabilizer for placement under said mattress of said bed, wherein said mattress comprises a first width, wherein said first horizontal stabilizer comprise a second width, wherein said second width is less than about 20 per cent of said first width; wherein said first horizontal stabilizer comprises a synthetic polymeric material with a density of from about 1 to about 10 pounds per cubic foot; and wherein disposing said first horizontal stabilizer under said mattress secures said first vertically-extending panel in a substantially-vertical orientation along a side of said bed; a first vertically-extending panel attached substantially perpendicularly to said first horizontal stabilizer, wherein said first vertically extending panel comprises a synthetic polymeric material with a density of from about 1 to about 10 pounds per cubic foot; a second safety panel comprising a second horizontal stabilizer for placement under said mattress of said bed, wherein said second horizontal stabilizer comprises a third width, wherein said third width is less than about 20 per cent of said first width; wherein said second horizontal stabilizer comprises a synthetic polymeric material with a density of from about 1 to about 10 pounds per cubic foot; and wherein disposing said second horizontal stabilizer underneath said mattress secures said second vertically-extending panel in a substantially-vertical orientation along a side of said bed; a second vertically-extending panel attached substantially perpendicularly to said second horizontal stabilizer, wherein said second vertically extending panel comprises a synthetic polymeric material with a density of from about 1 to about 10 pounds per cubic foot; and a cover, wherein said cover comprises a flame retardant, water-repellant material, and wherein said cover encloses said mattress, said first safety panel and said second safety panel. Placement of said horizontal stabilizer under said mattress secures said vertically-extending panel in a substantially-verticle orientation along a side of said bed.

Another embodiment comprises the foregoing side panel safety apparatus in combination with a safety rail of said bed, further comprising said safety rail, wherein said horizontal stabilizer blocks a person in said bed from moving a part of said person's body into contact with said safety rail such that said body part becomes entrapped from said contact.

Another embodiment comprises said vertically-extending panel comprising at least two movable vertical sections; said horizontal stabilizer comprising at least two horizontal stabilization sections, each said horizontal stabilization section attached substantially perpendicularly to one of said movable vertical sections; and a hinge assembly between two adjacent said movable vertical sections enabling said adjacent movable vertical sections to be rotated relative to one another within a vertical plane of said movable vertical sections.

Another embodiment disclosed is a side panel safety apparatus for a bed, comprising three horizontal stabilizers substantially as described above, each connecting to a vertically-extending panel substantially as described above and attached substantially perpendicularly to its respective horizontal stabilizer and rotatably connected to one another, wherein placement of said first, second and third horizontal stabilizers under said mattress secures said first, second and third vertically-extending panels in a substantially-vertical orientation along a side of said bed.

Also disclosed is a safety apparatus for a bed further comprised of a foam mattress.

Thus, having broadly outlined the more important features of the present invention in order that the detailed description thereof may be better understood, and that the present contribution to the art may be better appreciated, there are, of course, additional features of the present invention that will be described herein and will form a part of the subject matter of the claims appended to this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

It is therefore an object of this invention to eliminate or greatly reduce the risk of entrapments and injuries sustained therefrom. Preferably, the invention, through proper implementation and monitoring, will eliminate the need for bed safety rail entirely in some cases, or substantially limit the need for their use in others.

It is a further object of this invention to provide a mattress assembly that can be used with or without existing safety rails and which will minimize the likelihood of patient entrapment that exists with the prior art assemblies.

It is a further object of this invention to provide a method and apparatus for retrofitting existing beds so as to eliminate the safety problems set forth above, without having to replace the entire bed unit.

It is another object of the present invention to provide a portable mattress assembly that is durable and reliable.

It is another object of this invention to provide a mattress assembly that provides an economical safety device option for the user to protect against potential injuries from bed safety rails.

It is another object of this invention to provide a relatively simple mattress assembly that is economical from the viewpoint of the manufacturer and consumer.

It is an object of the present invention to provide a mattress assembly that is susceptible of low manufacturing costs with regard to labor and materials, and which accordingly is then susceptible of low prices for the consuming public, thereby making it economically available to the buying public.

It is a further object of this invention to provide a mattress assembly with sufficient vertically supporting walls which can be used in or out of a bed in conjunction with a mattress or other base padding to support a person comfortably.

It is a further object of this invention to provide a mattress assembly that has vertically self-supporting walls and may be disposed on said bed to maintain vertical and horizontal orientation when used in a hospital-genre bed.

It is a further object of this invention to provide a mattress assembly that is easily sanitized, washed and cleaned.

It is a further object of this invention to provide a mattress assembly that can be constructed with moisture-resistant or hygienic material for patient care uses such as changing, feeding or containment.

These and other objects of the invention will be described more fully below. In any embodiment of the present invention, one or more of the above-recited objects may be achieved, or any combination thereof. As many embodiments are possible and considered within the scope of the present invention, it is not anticipated that each embodiment will meet all of the above-recited objectives.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawings summarized below.

FIG. 4 is a top view of the side panel assembly of FIG. 3;

FIG. 5 is a side view of the side panel assembly of FIG. 3;

FIG. 6 is an end view of the side panel assembly of FIG. 3;

FIG. 7 is a top view of a side panel assembly embodiment with an ingress/egress cutout;

FIG. 8 is a side view of the cutout side panel assembly of FIG. 7;

FIG. 9 is an end view of the cutout side panel assembly of FIG. 7;

DETAILED DESCRIPTION OF A PREFERRED EMBODIMENT

Figure 1:
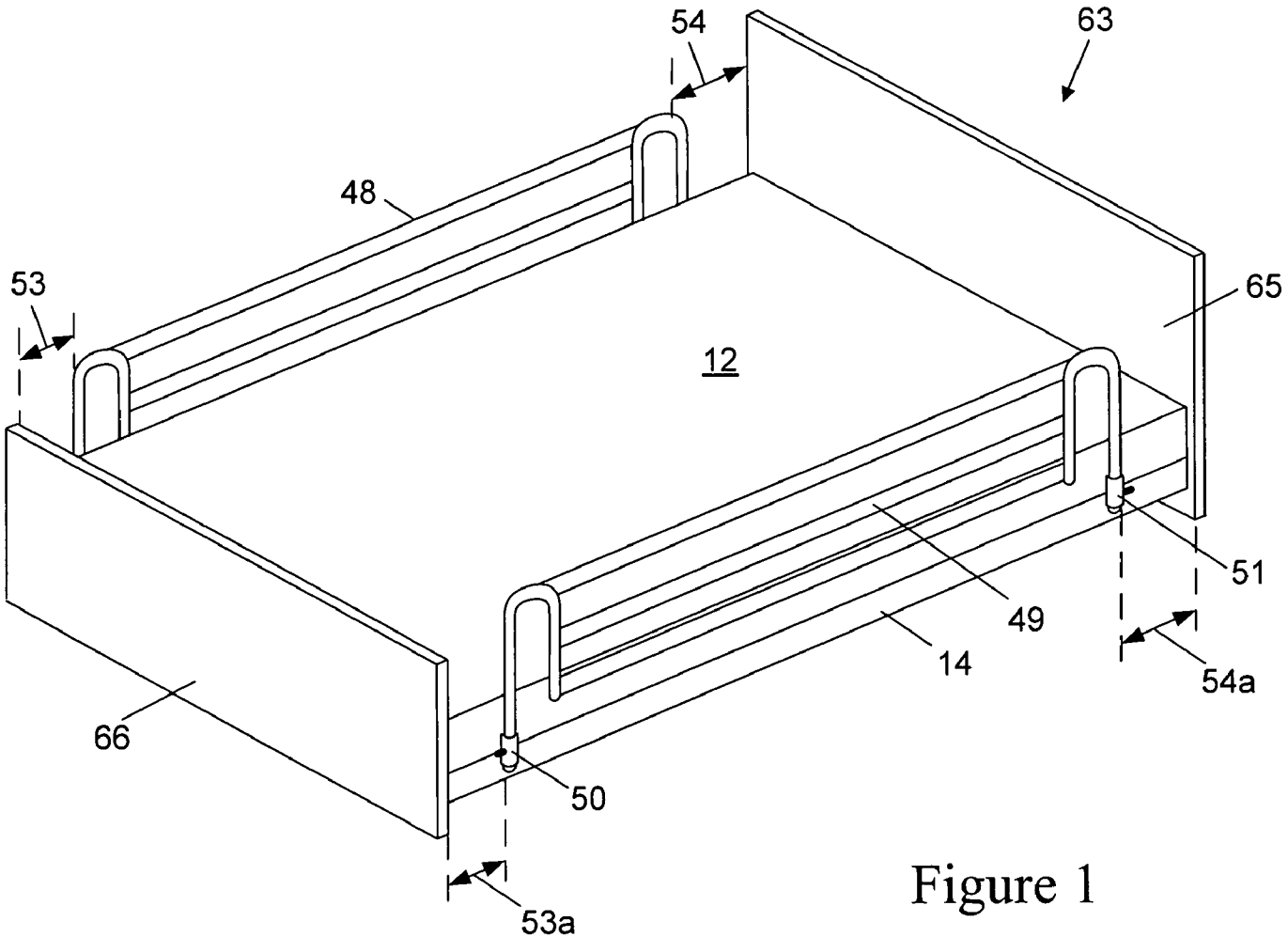
FIG. 1 is a perspective view of a bed assembly utilizing prior art bed safety rail assemblies.

FIG. 1 is a perspective view of a bed assembly 63 comprised of a mattress 12 and foundation 14, according to the prior art. Disposed on bed assembly 63 are Bed Safety Rail (bed safety rail) assemblies 48 and 49 respectively, shown in the raised or upper operating position. Bed safety rail 48/49 are held in place by two adjustable lateral supports 50 and 51, respectively. Lateral supports 50/51 extend at least the width of mattress 12 and are disposed between mattress 12 and foundation 14. In the lowered or down configuration, the bed safety rail 48/49 are irrelevant to patient safety as the patient (not shown) is generally out of bed when the bed safety rail 48/49 are in this configuration. These prior art bed safety rail assemblies are generally manufactured of metal but could be made of any material and be in any configuration or shape of those bed safety rail assemblies currently available on the open market.

Referring to FIG. 1, the length of bed safety rail assemblies 48/49 respectively, is typically not coextensive with the length of mattress 12. In one embodiment, the differences between these lengths 53, 54, 53*a* and 54*a* respectively are from about 2 to 24 inches. As is apparent, these differences create inherent "gaps" that pose a substantial risk to the patient, becoming entrapped between either the headboard 65 or the footboard 66 and the bed safety rail 48/49.

Figure 2:
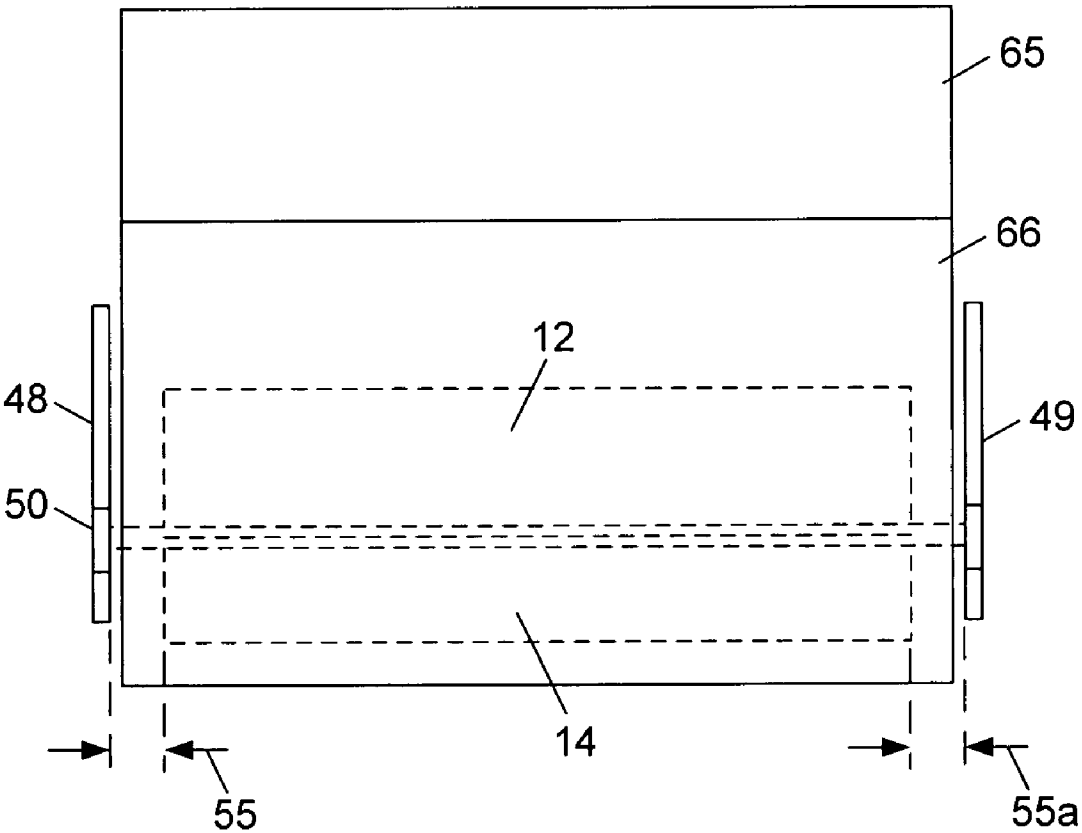
FIG. 2 depicts an end view of a bed assembly utilizing prior art bed safety rail assemblies.

FIG. 2 depicts an end view of the prior art bed assembly 63 of FIG. 1, comprised of mattress 12 (hidden from view), foundation 14 (hidden from view), bed safety rail 48/49, lateral supports 50 (partially shown) and 51 (not shown), headboard 65 (partially obstructed) and footboard 66.

Referring to FIG. 2, inherent gaps 55 and 55*a* are created between mattress 12 and bed safety rail 48/49. In one embodiment, the reason for this gap is the additional space required to raise and lower bed safety rail 48/49 in their normal function. In this illustration, gap 55/55*a* is from about 1-3 inches. Another reason for gap 55/55*a* is the limited adjustment capabilities of supports 50/51. These "gaps" pose a substantial risk to the patient, becoming entrapped between the mattress 12 and the bed safety rail 48/49.

Figure 3:
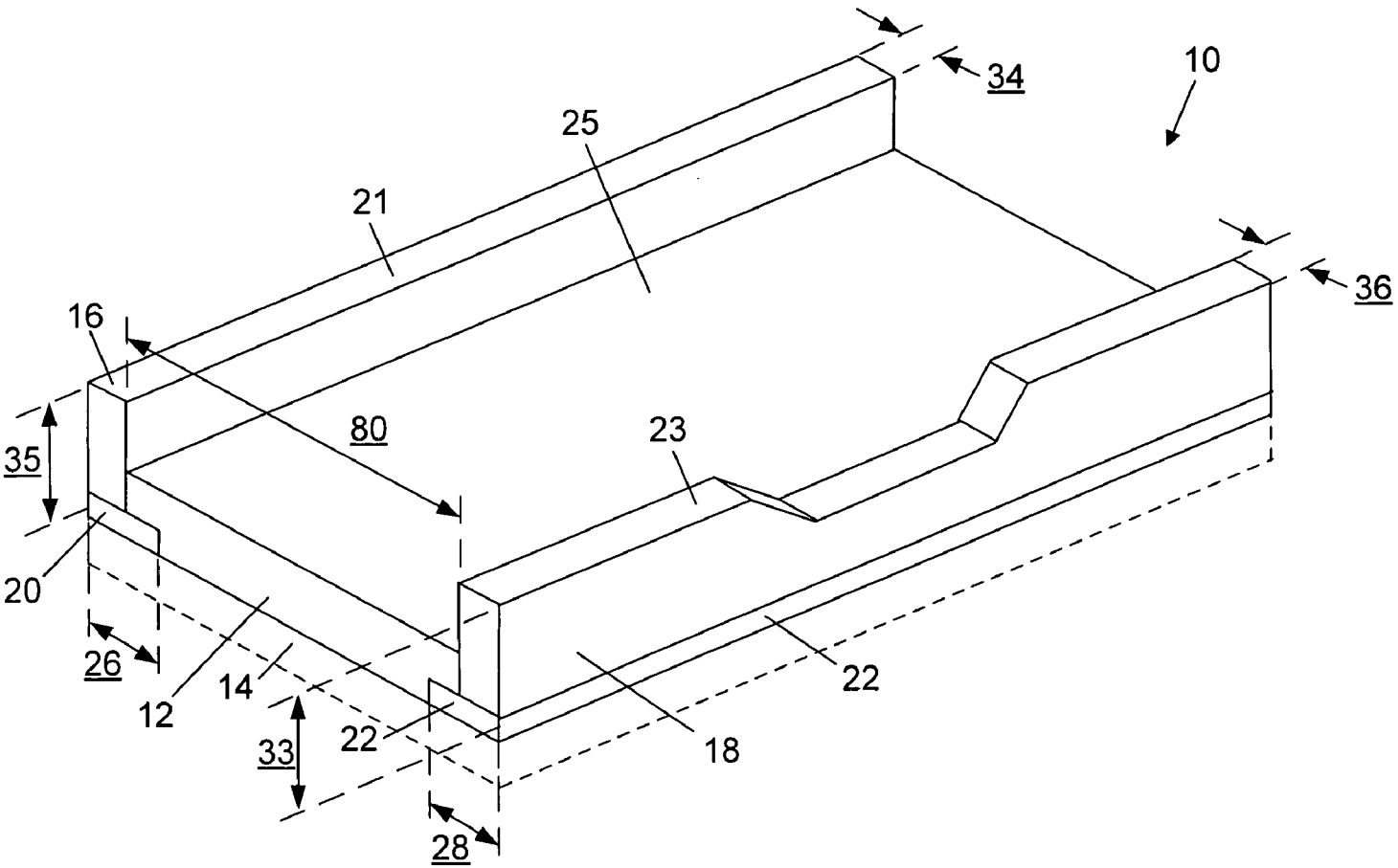
FIG. 3 is a perspective view of a mattress assembly in one embodiment of the invention.
Figure 10:
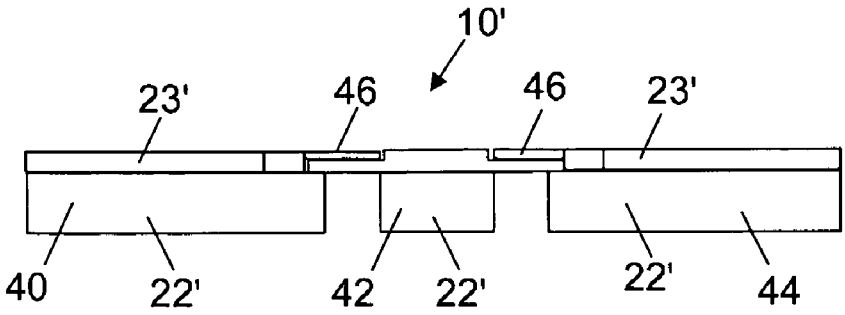
FIG. 10 is a top view of a movable side panel assembly embodiment.
Figure 11:
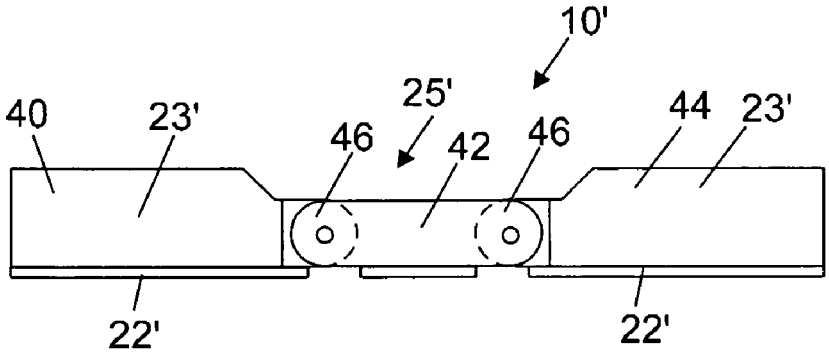
FIG. 11 is a side view of the movable side panel assembly of FIG. 10.
Figure 12:
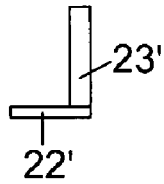
FIG. 12 is an end view of the movable side panel assembly of FIG. 10.
Figure 13:
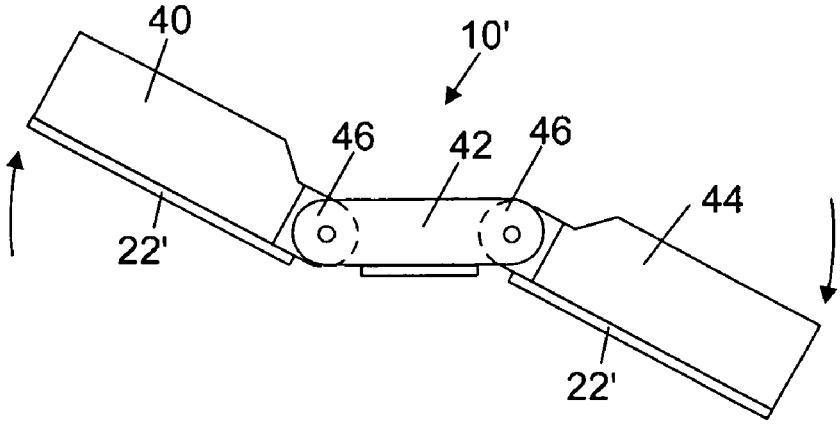
FIG. 13 is a side view of the movable side panel assembly of FIG. 10 illustrating movement of this assembly.

FIG. 3 is a perspective view of a mattress assembly 10 comprised of a mattress 12 disposed on a foundation 14. The foundation 14 may be any base on which a mattress typically sits. It may, e.g., be a box spring, a foundation, a spring platform, a plywood platform, etc. In some aspects of this invention, the base may even be the floor surface.

Referring again to FIG. 3, and disposed on both sides of the mattress 12, are side panels 16 and 18. One of the functions of these side panels 16/18 is to prevent a patient (not shown) disposed on such mattress from having inadvertent contact with structure outside of the side panels 16/18, such as safety rails (see FIGS. 1, 2, 16 and 17).

In the preferred embodiment depicted in FIG. 3, each of side panels 16/18 are preferably L-shaped structures that comprise horizontally extending stabilizers 20 and 22, respectively. The stabilizers 20/22 are preferably disposed, at least in part, underneath mattress 12. The stabilizer may disposed such that from about 20 to about 100 per cent of the surface area of the side of the stabilizer that is communicating with the mattress comes in contact with the surface area of the underside of the mattress. The mattress comprises a first surface area and the horizontal stabilizer comprises a second surface area such that when said horizontal stabilizer is placed at least partially underneath said mattress, said second surface area comprises from about 5 to about 50% of said first surface area. The width 26, 28 of the stabilizer comprises less than about 75%, preferably less than about 50%, and more preferably less than about 20% of the width 80 of the mattress 12. In one embodiment, the width 26, 28 of the stabilizer is less than about 5% of the width 80 of the mattress 12. In one embodiment, the width 26, 28 of the stabilizer is less than about 10% of the width 80 of the mattress 12.

In one embodiment, the mattress 12 is encased within a mattress cover. In another embodiment the mattress 12 is first wrapped with a fireproof material and then enclosed within a mattress cover.

In one embodiment, a fire barrier fabric is used to cover mattress 12, and side panel assemblies 16 and 18; a similar fire barrier fabric may be used to cover the comparable parts of assembly 10 (see FIGS. 10, 11, 12, and 13).

The assemblies 16/18 may be integral assemblies. Alternatively, one may separately make stabilizers 20/22 and join them to vertically-extending panels 21 and 23 using adhesion or a variety of similar attachment techniques known in the art.

Referring again to FIG. 3, it will be seen that vertically extending panel 23 is comprised of a cutout section 25 that, in the embodiment depicted, has a substantially inverted trapezoidal shape. In other embodiments, not shown, different shapes may be used for cutout section 25 including arcuate shapes (oval, circular), square shapes, triangular shapes, irregular shapes, and the like. The purpose of said cutout, irrespective of shape, is to allow the patient ingress and egress to and from the bed. Optionally, should it be required, to give the patient the opportunity to get into or out of bed on either side, said cutout can be made on either or both side panels.

FIGS. 4, 5, and 6 are top, side, and end views, respectively, of side panel assembly 16. In the preferred embodiment depicted in FIGS. 4, 5, and 6, the stabilizer 20 preferably has a width 26 of from about 4 to about 40 inches; as will be apparent, most of this width 26 will be disposed under mattress 12 (see FIG. 3). Similarly, and referring to FIG. 9, stabilizer 22 preferably has a width 28 of from about 4 to about 40 inches. The widths 26 and 28 may be identical, but need not be identical. In some embodiments, the width of the entire assembly is identical to the width of the bed frame such that mattress assembly lies substantially flush with the periphery of the bed frame, thus does not overhang the bed frame, while in use.

Referring to FIGS. 5 and 8, the stabilizers 20/22 preferably have thicknesses 30 and 32, respectively, of from about 1 to about 2 inches. In the embodiment depicted in FIG. 3, the stabilizer 22 is shown extending the entire length of panel 23. In one embodiment, stabilizers 20 and 22 are preferably coextensive with upstanding panels 21 and 23, i.e., their lengths are identical. In another embodiment, their regions of overlap run from about 45 to about 86 inches.

Referring to FIG. 3, and in the preferred embodiment depicted therein, each of vertically extending panels 21 and 23 preferably have thicknesses 25/27, respectively from about 1 to 4 inches.

Referring again to FIG. 3, and in the embodiment depicted, it will be seen that vertically extending panels 21/23 preferably have heights 35/37, respectively, of from about 6 to about 24 inches. It is preferred that the heights 35/37 be sufficient such that the panels 21/23 extend above the mattress 12 by from about 1 to about 18 inches. For example, in one embodiment, it is preferred that the panels 21/23 extend above the mattress 12 by at least about 4 inches. By way of further example, embodiments with panels 21/23 extending above the mattress 12 by at least about 5 inches (when measured from the top of the mattress to the top of the panel), by at least about 7 inches, and by at least about 9 inches, have particular application with prior art hospital beds and institutional settings.

As will be apparent from the drawings and description contained herein, the dimensions and L-shape of the side safety panels render them especially suitable for compact storage and shipping. Inverting one "L-shaped" panel and placing it over another panel thus create a tube having a rectangular cross-section created with a lumen within which the cover may be disposed.

Referring to FIG. 8, and in the embodiment depicted, it will be seen that the cutout 25 preferably has a maximum depth 27 of from about 2 to about 20 inches, and preferably from about 4 to about 8 inches.

FIGS. 10, 11, 12, and 13 illustrate an embodiment 10' that is similar to the embodiment 10 depicted in FIGS. 3 through 8 but differs therefrom in the following respects: (a) it has only one type of upstanding panel 23 (i.e., panel 23') rather than two different types, (b) it has only one type of stabilizer 22', and the stabilizer 22' is not coextensive with the movable vertical sections 40, 42, and 44 which correspond to head section 40, middle section 42, and foot section 44.

Figure 14:
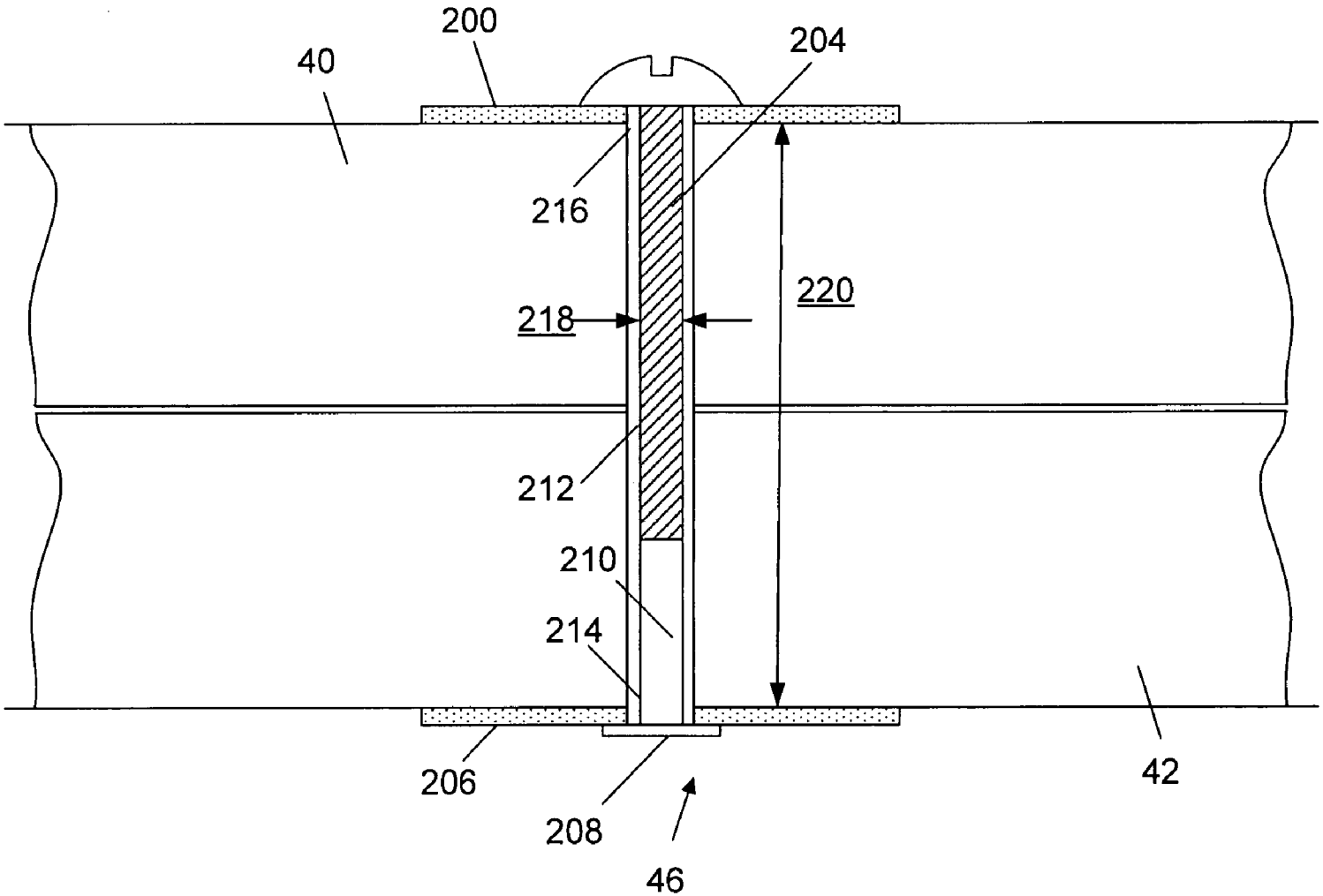
FIG. 14 is a perspective view of the hinge assembly that facilitates said movement illustrated in FIG. 13.

The middle section 42 is rotatably connected to each of head section 40 and foot section 44 by hinge assemblies 46. FIG. 14 is a schematic view, not drawn to scale, of one hinge assembly 46 connecting parts 40 and 42.

Referring again to FIG. 14 and the embodiment depicted, hinge assembly 46 comprises a nylon tubing 212, two washers 200, 206, a threaded T-nut 210 and a bolt 204. The bolt 204 may be a standard bolt of from about one inch to about 4 inches in length 220, preferably from about 2 inches to about 2 and one-half inches. As will be apparent to one skilled in the art, the washers 200, 206 and T-nut 210 may be appropriately sized to operatively work with the bolt and create a pivot point 204 about said bolt 204.

Although not a necessary element, an optional nylon sleeve 212 may be disposed at the juncture of two movable sections 40, 42, 44 of the side rail safety assembly forming a pivot. As will be apparent, this design is especially suited for use with a gatch type bed, e.g. an articulating or adjustable bed. Applicant believes that the use of a nylon sleeve 212 increases wearability at the pivot point 204 and enhances ease of use. As will be apparent from a reference to FIG. 14, the nylon sleeve 212 has two openings, oppositely disposed at the two ends 216, 214. As will also be apparent to those skilled in the art, the outer diameter 218 of the nylon sleeve 212 should be sized such that the nylon sleeve 212 snugly fits into the holes created in the two movable sections 40, 42, 44.

In using the hinge assembly 46, one may place a washer 200, 206 on both openings 214, 216 in the nylon tubing 212. Into one end of the nylon tubing 216, a threaded bolt 204 is inserted and operatively connected to an oppositely disposed threaded T-nut 210 at the opposite end opening 214 of the nylon tubing. In some embodiments, the T-nut 210 has an opening 208. The bolt 204 may emerge from this opening 208. In some embodiments, an adhesive such as the material sold under the trade name "Locktite" may be inserted into the hole to permanently secure the T-nut 210 to the bolt 204.

Referring to FIGS. 10-14, in one embodiment, hinge assembly 46 functions such that one movable section has an angle of rotation of from about one to about 270 degrees from the adjoining movable section, preferably from about one to about 110 degrees. More simply put, the head and/or the foot sections 40, 44 may rotate at an angle of from about one to about 270 degrees with respect to the middle section 42.

The assembly 10' preferably is disposed upon and contiguous with an adjustable hospital bed (not shown). As the position of the hospital bed changes, the hinge assemblies 46 allow the assembly 10' to change its shape. The sections 40, 42, and 44 may have identical dimensions, or they may have different dimensions. In the preferred embodiment depicted in FIGS. 10, 11, 12, and 13, each of sections 40 and 44 will preferably have a length of from about 24 to about 42 inches, and it is preferred that such lengths, in one embodiment, be equal. The length of middle section is preferably from about 16 to about 40 inches. But, it is understood that the dimensions of sections 40, 42, and 44 may be varied so as to accommodate differently-dimensioned adjustable hospital beds, also referred to as "gatch" beds, and are preferably governed by the particular adjustable bed with which they are intended to be used. Such beds are "traditional" hospital beds and have divided sections for independent elevation of a portion of a patient's body and can be manually raised and lowered by turning cranks located at the bottom of the bed. Typically, a patient's head and knees may be elevated. The number of sections may also be varied, so that two, three, four, or even more sections may be employed, depending upon the characteristics of the adjustable bed for which they are intended.

As such, one embodiment of the present invention comprises a side panel safety apparatus for a bed, comprising a first horizontal stabilizer for placement at least partially underneath a mattress of said bed, wherein said first horizontal stabilizer has a width of from about 4 to about 40 inches, thicknesses of from about 1 to about 2 inches and a length of from about 3 to about 8 feet. Such embodiment further comprises a second horizontal stabilizer for placement at least partially underneath a mattress of said bed, wherein said second horizontal stabilizer has a width of from about 4 to about 40 inches, a thicknesses of from about 1 to about 2 inches, and a length of from about 3 to about 8 feet. Optionally, such embodiment further comprises a third horizontal stabilizer for placement at least partially underneath a mattress of said bed, wherein said third horizontal stabilizer has a width of from about 4 to about 40 inches, a thicknesses of from about 1 to about 2 inches and a length of from about 3 to about 8 feet.

Such embodiment further comprises a first vertically-extending panel attached substantially perpendicularly to said first horizontal stabilizer; wherein said first vertically extending panel has a thickness of from about 1 to 4 inches, a length of from about 24 to about 42 inches, a height of from about 6 to about 24 inches. Said first vertically extending panel extends above said mattress by at least about 4 inches and is rotatably connected to a second vertically-extending panel.

As used in this specification, substantially perpendicularly means that the vertically extending panel is disposed at an angle of from about 70 to about 120 degrees from the plane of the stabilizer. As used in this specification, vertically extending means that the vertically extending panel is disposed in a plane perpendicular to the plane of the stabilizer. Such perpendicular plane may be at an gangle of from about 70 to about 120 degrees from the plane of the stabilizer. As used in this specification, substantially vertical orientation means that the vertically extending panel is disposed in a plane perpendicular to the plane of the stabilizer. Such perpendicular plane may be at an angle of from about 70 to about 120 degrees from the plane of the stabilizer.

Such embodiment further comprises a said second vertically-extending panel attached substantially perpendicularly to said second horizontal stabilizer wherein said second vertically extending panel has a thickness of from about 1 to 4 inches, a length of from about 16 to about 40 inches, and a height of from about 6 to about 24 inches. Said second vertically extending panel extends above said mattress by at least about 4 inches and is rotatably connected to said first vertically extending panel. In some embodiments, said second vertically-extending panel is rotatably connected to said first vertically extending panel and a third vertically extending panel.

Optionally, such embodiment further comprises a third vertically-extending panel attached substantially perpendicularly to said third horizontal stabilizer wherein said third vertically extending panel has a thickness of from about 1 to 4 inches, a length of from about 24 to about 42 inches and a height of from about 6 to about 24 inches. Said third vertically extending panel extends above said mattress by at least about 4 inches and is rotatably connected to said second vertically extending panel. Placement of said first, second and third horizontal stabilizers at least partially underneath said mattress secures said first, second and third vertically-extending panels in a substantially-vertical orientation along a side of said bed.

Figure 15:
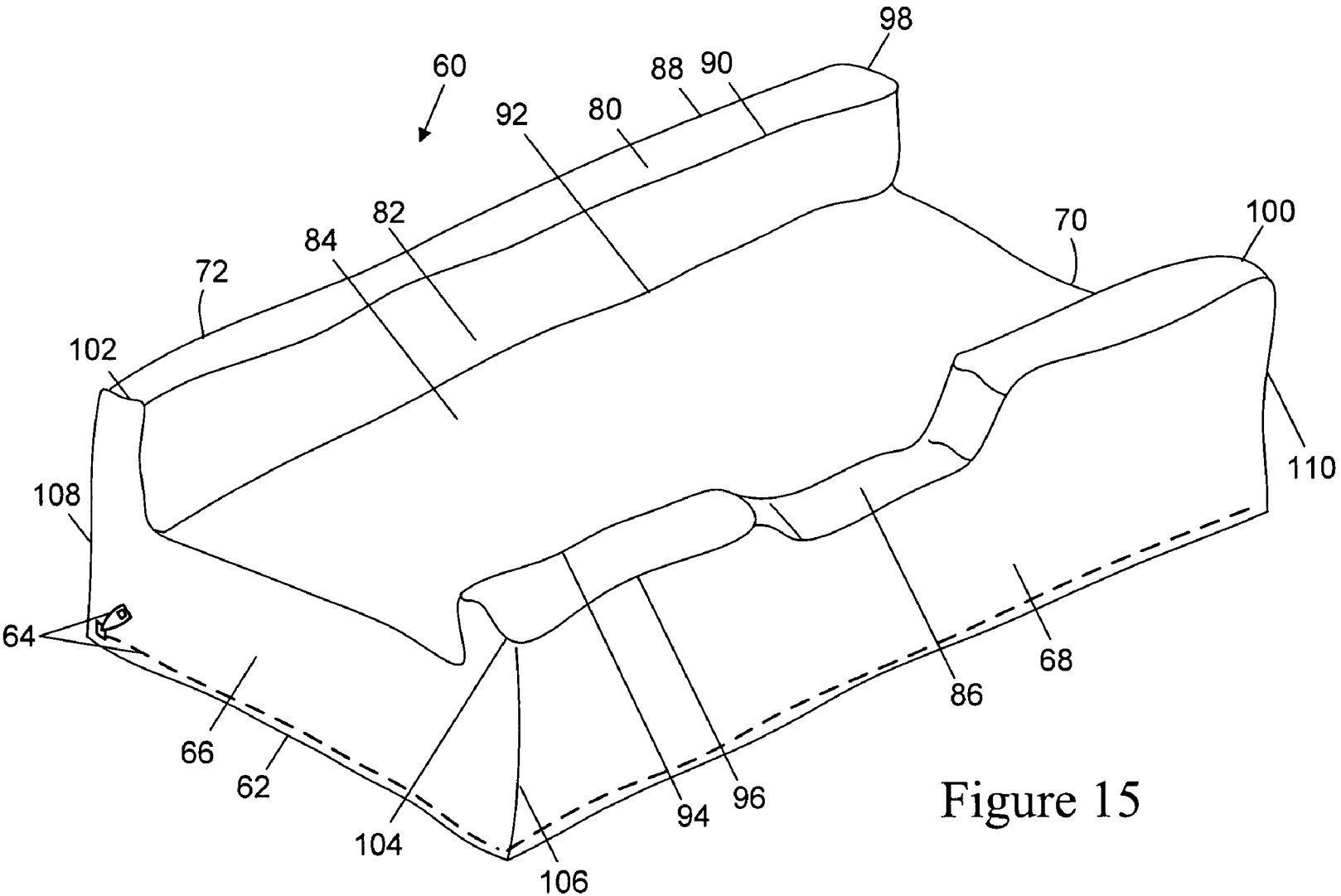
FIG. 15 is a perspective view of a full assembly in various embodiments covered by a cover.

FIG. 15 is a perspective view of a covered mattress assembly 60 comprised of a cover 62. As will be apparent, the assembly being covered (not shown in FIG. 15) is substantially identical to the assembly 10 of FIG. 3, or to the assembly 10' of FIG. 10, whether those assemblies are covered by a fire barrier fabric or not. It is optional although highly preferred that, prior to the time cover 62 is used to encase the entire assembly 10, or 10', the fire barrier "big socks" be disposed around the individual elements of such assemblies (such as, e.g., the mattress 12, and/or the side panel assemblies 16/18).

The cover 62 is preferably comprised, or consists essentially, of fabric made from synthetic polymeric material. The fabric in cover 62 preferably will have flame-retardant, anti-bacterial, and anti-microbial properties. In another embodiment, cover 62 has water repellant, anti-bacterial, and anti-microbial properties. Cover 62 is preferably tailored to fit snugly about the assemblies 10 and 10', though for the 10' (adjustable bed) configuration, the tailoring of cover 62 may require some play for movement of the adjustable bed into various positions other than horizontally flat.

In other embodiments, cover 62 may be comprised of two or more materials. In one embodiment, cover 62 is comprised of two materials. Portions which come into contact with the patient such as sides 82, 84 (and corresponding wall opposite side 82 hidden from view), may be comprised of a material with flame-retardant, anti-bacterial, and anti-microbial properties that is comfortable during periods of prolonged skin contact. In some embodiments, only one or two of these properties is present in the cover material. By way of demonstration, but not limitation, one commonly used material for medical and institutional applications is RoyalTouch™. Such material may be obtained from DAF Products, 420 Braen Avenue, Wycoff, N.J. 07481. This material is a 70 denier nylon taffeta with a 3 mil PVC backing and weighs 7.5 ounces per square yard.

Portions which do not habitually come into contact with patients such as sides 72, 66, 68, 70, 80 and 86 may be comprised of a material sold under the trade name Staph-Chek™, more fully described elsewhere in this application. In another embodiment, one may use DAF-Anti-Bac 9-1 (Such material may be obtained from DAF Products, 420 Braen Avenue, Wycoff, N.J. 07481), a material with a tensile strength of 5100 and a tear strength of 5134 when tested under ASTM 5041 and federal test Method 191. Such material is mildew-resistant, non-toxic, anti-static, and has a draise primary skin irritation index of zero. The material has anti-bacterial properties when tested under New York State 63 testing methods. The material has anti-fungal properties (gram positive and gram negative) when tested under AATCC method 30-1988 99% testing methods and weighs 8.5 ounces per square yard.

It is to be understood that any of the sides may be made of either material or combinations thereof, or comparable materials with some of all of the properties described above, and are considered to be within the scope of this invention. So, for example, in one embodiment, sides 80, 86, 82 and 84 may be comprised of RoyalTouch™ and in yet another embodiment, sides 80, 86, 82, 72, 68 and 84 may be comprised of RoyalTouch™.

As will be apparent from reference to FIG. 15, cover 62 is shaped to fit snugly around the side safety rails and mattress. As such, the dimensions will be substantially the same as disclosed herein for two side safety rails used in combination with a mattress. Optionally, in some embodiments, where a "corner" is formed along the periphery, a seam seal may be employed. By way of example, but not limitation, a seam seal may be employed at corners such as 98, 88, 102, 108, 104, 106, 96, 94, 100, 100, 112 and the like. Such a seam seal functions to enhance the durability and strength of such "corner" during use. In one embodiment, a seam seal is employed by running a thin piping of a liquid CVV adhesive material such as the material sold under the name Herculite™ (Herculite Products, Inc., P.O. Box 786, York, Pa. 17405) at the "corner". In another embodiment, one may form a seam seal by any means known to one skilled in the art.

In a preferred embodiment, no seam seal is employed at corner 92 and the opposing corner (hidden from view). Applicant believes that patient comfort is enhanced where no irritating seam is disposed at or near the sleeping surface. Additionally, applicant believes that a seam seal at this location 92, in some situations, is an attractive nuisance for bored or compulsive patients to tear away at, decreasing the wearability of the cover.

Referring again to FIG. 15, and in the preferred embodiment depicted therein, a zipper 64 is shown extending around side 66 and 68. It is preferred that the zipper also extend around side 70. The zipper may, but need not, also extend around back side 72. In one embodiment depicted, zipper 64 is disposed about the peripheral corner of the mattress. As will be apparent, the zipper may be disposed about the cover in any manner that allows the user to insert and remove the contents therefrom.

The zipper 64 preferably is constructed from a plastic material, although it may be constructed from metal.

Figure 16:
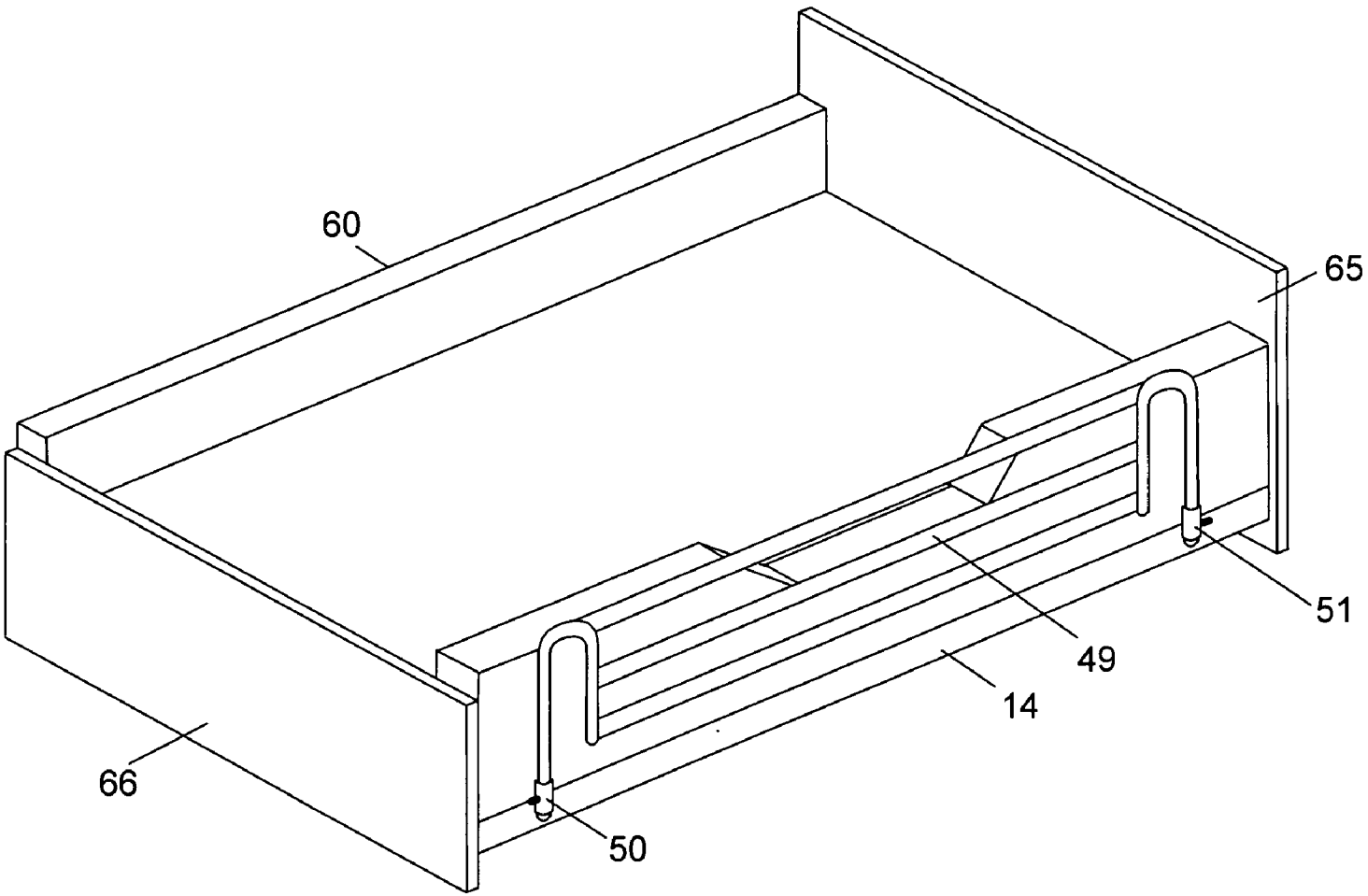
FIG. 16 is a perspective view of a bed assembly which can be in any embodiment of the invention, in combination with a prior art bed safety rail, with the bed safety rail shown in the upper position.
Figure 17:
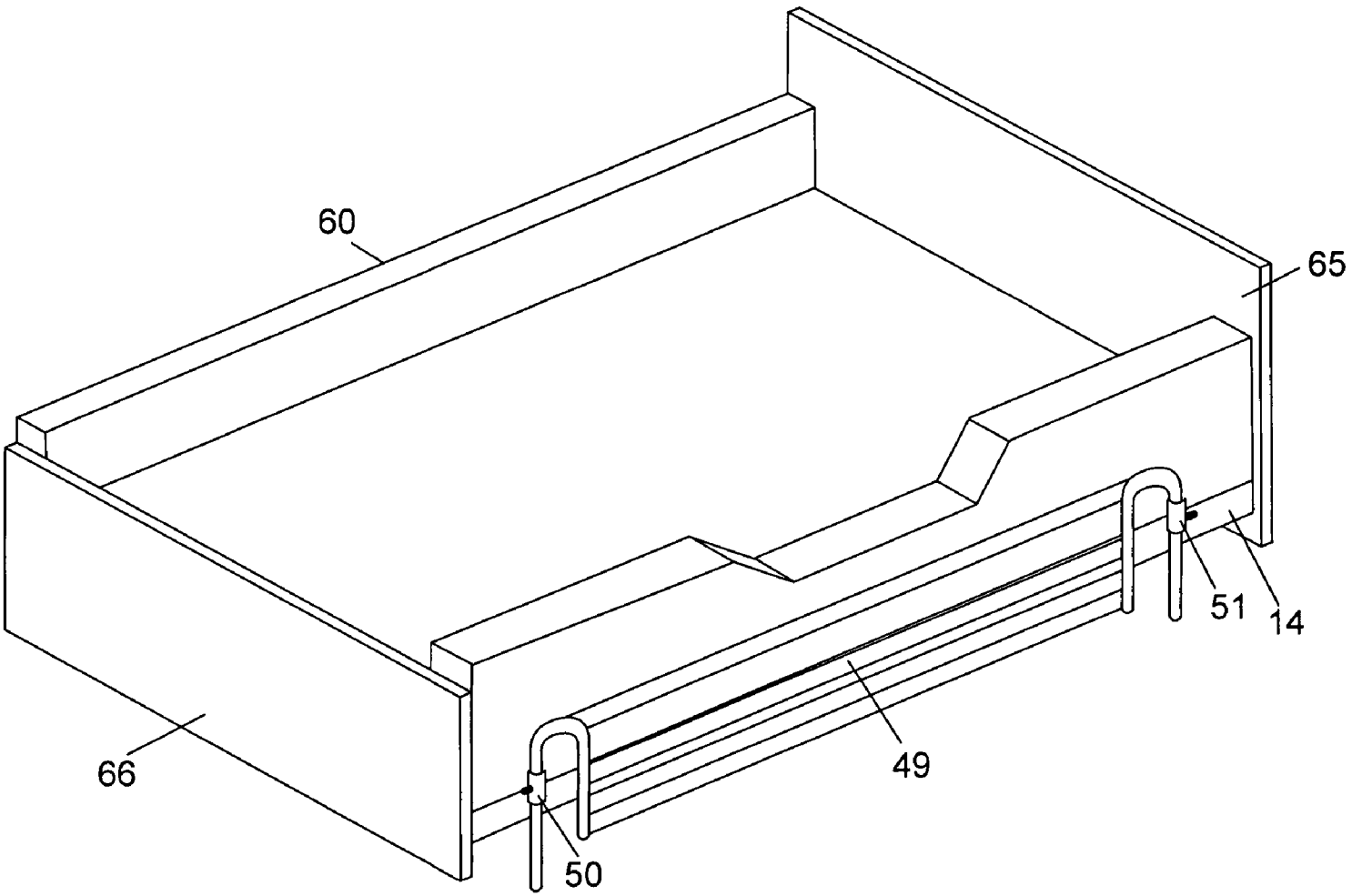
FIG. 17 is a perspective view of a bed assembly according to FIG. 16, with the bed safety rail shown in the lowered position.

FIGS. 16 and 17 illustrate a preexisting bed with a Bed Safety Rail (bed safety rail), which has been retrofitted with a present invention embodiment to eliminate the safety hazards earlier discussed. That is, these figures illustrate an embodiment of the invention in combination with a preexisting bed and prior art bed safety rail system.

Referring to FIG. 16, depicting covered mattress assembly 60 in place, in combination with the bed safety rail 48 (obscured from view), and 49 in the upper position, individuals, primarily those of diminished mental or physical capacity, are "trained" to learn the lateral limits of their respective bed assembly, by coming in contact with the elevated side panel 16 or 18 prior to bed safety rail 48/49. This training process will preferably take from about 1 to 4 weeks, although in some cases, a longer time may be required.

Following this training period utilizing this combination of bed assembly 60 and the bed safety rail 48/49 assemblies, the bed safety rail 48/49 will remain in place on the bed assembly in the lowered or down position as depicted in FIG. 17. This adjustment period will preferably take from about 1 to 4 weeks, although in some cases, a longer time may be required.

During this adjustment period, frequent (e.g., every 15 minutes) bed checks will be made to ensure that no notable events, or safety issues arise. As the adjustment period progresses, the frequency of said bed checks may be extended as is clinically appropriate.

In the embodiments shown, it is highly preferred, but optional, to cover all of the surfaces of each of these structures with the fire barrier fabric. Instead of using fire barrier fabric, one may use any other fire barrier materials, such as foams, coatings, etc.

One may use any of the fire barrier fabrics that are commercially available. In one embodiment, the fire barrier fabric is "INTEGRITY 30," sold by the Vented Company of PLO. Box 1038, Great Falls, Va. This material is a knitted fire barrier that comprises modacrylic fiber, fiberglass, and polyester fiber. In one embodiment, it is affixed to the assemblies depicted by either metal staples, or glass thread, or Kevlar thread, or any other suitable equivalent attachment means. In another embodiment, it is used to make a cover that is disposed over each respective assembly but is not necessarily affixed thereto. In this latter embodiment, the fire barrier fabric made from the fire barrier fiber may be referred to as a "big sock."

The side panels 16 and 18 preferably are assemblies that, in one embodiment, are made from a synthetic polymeric material. It is preferred that the material used to make the side safety panels be lightweight and sturdy. In one embodiment, the density of the polymeric material is from about 1 to about 10 pounds per cubic foot. In some embodiments, the polymeric material has flame-retardant properties. In yet other embodiments, the polymeric materials are coated or covered with flame-retardant materials. As used in this specification density means mass per cubic foot.

In one embodiment, it is preferred that the synthetic polymeric material have density of less than about 3 pounds per cubic foot and, more preferably, less than about 2.5 pounds per cubic foot. In one embodiment, the density of the polymeric material is less than about 2.3 pounds per cubic foot.

In one embodiment, the polymeric material has an indentation load deflection (ILD) of from about 50 to about 500 pounds and, more preferably, from about 100 to about 250 pounds. In one aspect of this embodiment, the material has an ILD of from about 75 to about 200 pounds. As used in this specification, indentation load deflection (ILD) is also referred to as indentation force deflection (IFD) in the metric system and is defined as the amount of force, in pounds, required to indent a fifty square inch, round indentor foot into a predefined foam specimen a certain percentage, usually 25%, of the specimen's total thickness. IFD may be tested by ASTM standard methods described in ASTM D3574.

It is preferred that the polymeric material be substantially inflammable. As used in this specification, the term substantially inflammable refers to a material that passes a test such as described in California Technical Bulletin 117, or a similar set of standards.

In one embodiment, the polymeric material is a polyethylene that preferably is a high density polyethylene with crystallinity in excess of about 80 percent. As used in this specification, crystallinity means the relative amount of crystalline region and amorphous region (volume or mass basis) and may be tested by differential scanning calorimetry technique, density gradient technique (ASTM D1505), X-ray scattering or NMR.

In another embodiment, the polymeric material is polyethylene foam. In one aspect of this embodiment, the polyethylene foam is "ETHAFOAM 4101" sold by the Dow Chemical Company of Midland, Mich. The material has a compression set, as measured by ASTM D3575 (Suffix B) of less than about 20 percent. As used in this specification, compression set means the extent to which the polymeric material is permanently deformed by a prolonged compressive load.

In another embodiment, the polymeric material is polyurethane with an ILD of from about 50 to about 500 pounds. Other similar polymeric materials possessing equal or greater qualities also may be used.

One material that may be used to make cover 62 is "DAF AntiBac" manufactured by DAF Products, Inc., 420 Braen Avenue, Wyckoff, N.J. The material has a weight of from about 9 to about 15 ounces per square yard and is made from a 3-ply polyvinyl chloride reinforced laminate. This material is flame resistant passing California Technical Bulletin test 117 and NFPA 701 Small Scale), it is mildew resistant, and it is antibacterial. Other similar fabrics possessing equal or greater qualities also may be used.

This invention accomplishes its objects through providing solid "gap free" side panels 16 and 18 disposed on mattress 12 and encased in cover 62 with or without the fire barrier "big socks". This eliminates the gaps 53/53*a*, 54/54*a*, and 55/55*a* as previously described, as well as any interbar spacing inherent in the bed safety rail 48/49 as depicted, or otherwise not shown.

Another unique feature of the product is that no sleep surface is lost when the disclosed assembly is used, because it is applied to the outside edges of the mattress and does not at all overlap the top surface of the mattress. As will be known by those skilled in the art, a conventional hospital bed is 35 inches by 80 inches, thus having a sleeping surface of 2800 square inches. Thus, 100% or all 2800 square inches of sleeping surface are available for the user patient. Contrarily, inflatable devices and other physical barrier devices placed on the mattress surface reduce the sleep surface available to the patient by 1-30% that is from about 28 to 840 square inches, or even more in some cases. With patients of various sizes, requiring various medical equipment disposed about the body, and resting in various sleeping positions, the present invention presents obvious comfort advantages to the user and caregiver.

Preferably, this invention will initially be used as a training device, installed on any given patient's bed assembly that indicates the use of bed safety rail 48/49 assemblies.

With the invention in place, and the bed safety rail 48/49 in the upper position, individuals, primarily those of diminished mental or physical capacity, are "trained" to learn the lateral limits of their respective bed assembly, by coming in contact with the elevated side panel 16 or 18 prior to bed safety rail 48/49. This training process will preferably take from about 1 to 4 weeks, although in some cases, a longer time may be required.

Following this training period utilizing both this invention and the bed safety rail 48/49 assemblies, the bed safety rail 48/49 will remain in place on the bed assembly in the lowered or down position. This adjustment period will preferably take from about 1 to 4 weeks, although in some cases, a longer period may be required.

During this adjustment period, frequent (every 15 minutes) bed checks will be made to ensure that no notable events, or safety issues arise. As the adjustment period progresses, the frequency of said bed checks may be extended as is clinically appropriate.

Preferably, upon completion of these training and adjustment periods, all parties involved with the care of each individual including but not limited to staff, nurses, doctors, occupational and physical therapists, family members, and even in some case patients will be comfortable with completely removing the bed safety rail 48/49 assemblies, thus removing any risk of entrapment with bed safety rail assemblies.

In one embodiment, a solid foam core material mattress comprises part of the assembly. A mattress may be combined with one, or optionally more, side safety panels. In one preferred embodiment, the mattress is combined with two side safety panels. The mattress may be used in lieu of or in addition to a standard or pre-existing mattress. In one embodiment, the foam mattress is substantially the size of a conventional single bed, 39 inches by 75 inches and a depth of 7 inches. This embodiment is particularly suited to residential non-institutional applications. In another embodiment, the foam mattress is substantially the size of a hospital or gatch bed, 35 inches by 80 inches and a depth of 7 inches. This embodiment is particularly suitable for institutional applications. It is to be understood that the mattress may be formed in any size or shape that is convenient to the user of may be required for use with particular beds. The dimensions described are for example and should not be seen as limiting.

As such, one embodiment of the present invention comprises a side panel safety bed assembly comprising a mattress and a first side safety panel as described elsewhere in this specification. Another embodiment of the present invention comprises a side panel safety bed assembly comprising a mattress, a first side safety panel as described elsewhere in this specification and a second side safety panel as described elsewhere in this specification. In yet another embodiment, a cover as described elsewhere in this specification comprises part of the assembly. In one embodiment, the first side safety panel has a cutout as described elsewhere in this specification. In one embodiment, the first and second side safety panels have a cutout as described elsewhere in this specification.

In one embodiment of the mattress, one may use a polymeric material, such as polyurethane, with an ILD of from about 18 to about 65 pounds fully encased within a vinyl or fabric covering. By way of example, but not limitation, one may use Staph Check™ materials as a covering. Other similar polymeric materials possessing equal or greater qualities also may be used. In one embodiment, one may use a synthetic polymeric material with a density of from about 1.2 to about 3.5 pounds per cubic foot. In yet another embodiment, one may use an innerspring core mattress with a fiber or foam topper.

Thus one embodiment of the present invention is a safety apparatus for a bed comprised of a first safety panel comprising a first horizontal stabilizer for placement under said mattress of said bed, wherein said mattress comprises a first width, wherein said first horizontal stabilizer comprise a second width, wherein said second width is less than about 20 per cent of said first width; wherein said first horizontal stabilizer comprises a synthetic polymeric material with a density of from about 1 to about 10 pounds per cubic foot; and wherein disposing said first horizontal stabilizer under said mattress secures said first vertically-extending panel in a substantially-vertical orientation along a side of said bed; a first vertically-extending panel attached substantially perpendicularly to said first horizontal stabilizer, wherein said first vertically extending panel comprises a synthetic polymeric material with a density of from about 1 to about 10 pounds per cubic foot; a second safety panel comprising a second horizontal stabilizer for placement under said mattress of said bed, wherein said second horizontal stabilizer comprises a third width, wherein said third width is less than about 20 per cent of said first width; wherein said second horizontal stabilizer comprises a synthetic polymeric material with a density of from about 1 to about 10 pounds per cubic foot; and wherein disposing said second horizontal stabilizer underneath said mattress secures said second vertically-extending panel in a substantially-vertical orientation along a side of said bed; a second vertically-extending panel attached substantially perpendicularly to said second horizontal stabilizer, wherein said second vertically extending panel comprises a synthetic polymeric material with a density of from about 1 to about 10 pounds per cubic foot; and a cover, wherein said cover comprises a flame retardant, water-repellant material, and wherein said cover encloses said mattress, said first safety panel and said second safety panel. Placement of said horizontal stabilizer under said mattress secures said vertically-extending panel in a substantially-vertical orientation along a side of said bed.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A safety apparatus for a bed comprised of a mattress, comprising:

a. a first safety panel comprising a first horizontal stabilizer for placement under said mattress of said bed and a first vertically-extending panel attached substantially perpendicularly to said first horizontal stabilizer, wherein said mattress comprises a first width, wherein said first horizontal stabilizer comprises a second width, wherein said second width is less than about 20 per cent of said first width; wherein said first horizontal stabilizer and said first-vertically extending panel each comprises a synthetic polymeric material with a density of from about 1 to about 10 pounds per cubic foot; and wherein disposing said first horizontal stabilizer under said mattress secures said first vertically-extending panel in a substantially-vertical orientation along a side of said bed;

b. a second safety panel comprising a second horizontal stabilizer for placement under said mattress of said bed and a second vertically-extending panel attached substantially perpendicularly to said second horizontal stabilizer, wherein said second horizontal stabilizer comprises a third width, wherein said third width is less than about 20 per cent of said first width; wherein said second horizontal stabilizer and said second vertically-extending panel each comprises a synthetic polymeric material with a density of from about 1 to about 10 pounds per cubic foot; and wherein disposing said second horizontal stabilizer underneath said mattress secures said second vertically-extending panel in a substantially-vertical orientation along a side of said bed; and c. a cover, wherein said cover comprises a flame retardant, water-repellant material, and wherein said cover encloses said mattress, said first safety panel and said second safety panel.

2. The safety apparatus of claim 1, wherein said first vertically-extending panel further comprises a cutout section, wherein said cutout section has a depth of from about 2 to about 20 inches.

3. The safety apparatus of claim 2, wherein said first vertically extending panel further comprises a cutout section, wherein said cutout section has depth of from about 4 to about 8 inches.

4. The safety apparatus of claim 2, wherein said cutout section comprises a substantially inverted trapezoidal shape.

5. The safety apparatus of claim 1, wherein said cover material further comprises a material with antimicrobial properties.

6. The safety apparatus of claim 5, wherein said cover material further comprises a material with flame retardant properties.

7. The safety apparatus of claim 1, wherein said synthetic polymeric material has a compression set of less than about 20 per cent.

8. The safety apparatus of claim 1, wherein said synthetic polymeric material has an indentation force deflection of from about 50 to about 500 pounds.

9. The safety apparatus of claim 8, wherein said synthetic polymeric material has an indentation force deflection of from 75 to about 200 pounds.

10. The safety apparatus of claim 1, wherein said synthetic polymeric material has a crystallinity in excess of about 80 per cent.

11. The safety apparatus of claim 10, wherein said synthetic polymeric material comprises high density polyethylene.

12. The safety apparatus of claim 1 in combination with a safety rail of said bed, further comprising said safety rail; wherein said horizontal stabilizer blocks a person in said bed from moving a part of said person's body into contact with said safety rail such that said body part becomes entrapped from said contact.

13. The safety apparatus of claim 1, wherein said first and second horizontal stabilizer have a width of from about 4 to about 40 inches; wherein said first and second horizontal stabilizer have a thicknesses of from about 1 to about 2 inches; wherein said first and second horizontal stabilizer have a length of from about 3 to about 10 feet; wherein said first and second vertically extending panel have a thickness of from about 1 to 4 inches; wherein said first and second vertically extending panel have a height of from about 6 to about 24 inches; and wherein said first and second vertically extending panels extend above said mattress by at least about 4 inches.

14. A safety apparatus for a bed comprised of a mattress, comprising:

a. a first safety panel comprising a first horizontal stabilizer for placement under said mattress of said bed and a first vertically-extending panel attached substantially perpendicularly to said first horizontal stabilizer, wherein said mattress comprises a first width, wherein said first horizontal stabilizer comprises a second width, wherein said second width is less than about 20 per cent of said first width, wherein said first horizontal stabilizer and said first vertically extending panel each comprises a synthetic polymeric material with a density of from about 1 to about 10 pounds per cubic foot, wherein said first safety panel further comprises a first cutout section, wherein said first cutout section has a depth of from about 4 to about 8 inches, and wherein disposing said first horizontal stabilizer under said mattress secures said first vertically-extending panel in a substantially-vertical orientation along a side of said bed;

b. a second safety panel comprising i. a second horizontal stabilizer for placement under said mattress of said bed, wherein said second horizontal stabilizer comprises a third width, wherein said third width is less than about 20 per cent of said first width; wherein said second horizontal stabilizer comprises a synthetic polymeric material with a density of from about 1 to about 10 pounds per cubic foot; and wherein disposing said second horizontal stabilizer under said mattress secures said second vertically-extending panel in a substantially-vertical orientation along a side of said bed;

ii. a second vertically-extending panel attached substantially perpendicularly to said second horizontal stabilizer; wherein said second vertically extending panel comprises a synthetic polymeric material with a density of from about 1 to about 10 pounds per cubic foot; wherein said second safety panel further comprises a second cutout section, wherein said second cutout section has a depth of from about 4 to about 8 inches;

c. a mattress; and d. a cover, wherein said cover comprises a flame retardant, water-repellant material, and wherein said cover encloses said mattress, said first safety panel and said second safety panel.

15. The safety apparatus of claim 14, wherein said mattress comprises a solid foam core material mattress comprised of a. a polyurethane foam pad, wherein said polyurethane foam pad comprises a polyurethane having an indentation force deflection of from about 18 to about 65 pounds, and wherein said polyurethane foam pad comprises a polyurethane having a density of from about 1.2 to about 3.5 pounds per cubic foot; and b. a foam covering, and wherein said polyurethane foam pad is fully encased within said foam covering.

16. The safety apparatus of claim 15, wherein said foam covering comprises vinyl.

17. The safety apparatus of claim 15, wherein said mattress has a width of about 39 inches and a length of about 75 inches.

18. The safety apparatus of claim 15, wherein said mattress has a width of about 35 inches and a length of about 80 inches.

19. A safety apparatus for a bed comprising a mattress, comprising:

a. a first horizontal stabilizer for placement under said mattress of said bed, wherein said mattress comprises a first width, said first horizontal stabilizer comprises a second width, wherein said second width is less than about 20 per cent of said first width;

b. a second horizontal stabilizer for placement under a mattress of said bed, wherein said second horizontal stabilizer comprises a third width, wherein said third width is less than about 20 per cent of said first width;

c. a first vertically-extending panel attached substantially perpendicularly to said first horizontal stabilizer, wherein said first vertically extending panel extends above said mattress by at least about 4 inches and wherein said first vertically-extending panel is rotatably connected to a second vertically-extending panel;

d. said second vertically-extending panel attached substantially perpendicularly to said second horizontal stabilizer, wherein said second vertically extending panel extends above said mattress by at least about 4 inches, and wherein said second vertically extending panel is rotatably connected to said first vertically extending panel;

e. a first hinge; and f. wherein placement of said first and second horizontal stabilizers at least partially underneath said mattress secures said first and second vertically-extending panels in a substantially-vertical orientation along a side of said bed.

20. The safety apparatus of claim 19, further comprising a. a third horizontal stabilizer for placement under a mattress of said bed, wherein said third horizontal stabilizer comprises a fourth width, wherein said fourth width is less than about 20 per cent of said first width;

b. said third vertically-extending panel attached substantially perpendicularly to said third horizontal stabilizer; wherein said third vertically extending panel extends above said mattress by at least about 4 inches; wherein said third vertically extending panel is rotatably connected to said second vertically extending panel; wherein said second vertically extending panel is rotatably connected to said first vertically extending panel and a third vertically extending panel;

c. a second hinge;

d. wherein placement of said first, second and third horizontal stabilizers under said mattress secures said first, second and third vertically-extending panels in a substantially-vertical orientation along a side of said bed.

* * * * *